US011387586B2

(12) United States Patent
Durse et al.

(10) Patent No.: US 11,387,586 B2
(45) Date of Patent: Jul. 12, 2022

(54) HIGH VOLTAGE (HV) TERMINAL FRAME AND METHOD OF MANUFACTURING THE SAME

(71) Applicant: Aptiv Technologies Limited, St. Michael (BB)

(72) Inventors: Nicholas A. Durse, Youngstown, OH (US); Joseph Sudik, Jr., Niles, OH (US); William C. Lovitz, Niles, OH (US); Jeffrey A. Janis, Warren, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/092,859

(22) Filed: Nov. 9, 2020

(65) Prior Publication Data

US 2022/0149553 A1 May 12, 2022

(51) Int. Cl.

| | |
|---|---|
| ***H01R 13/187*** | (2006.01) |
| ***H01R 43/16*** | (2006.01) |
| ***H01R 24/20*** | (2011.01) |
| ***H01R 13/11*** | (2006.01) |

(52) U.S. Cl.

CPC ..... *H01R 13/187* (2013.01); *H01R 13/113* (2013.01); *H01R 24/20* (2013.01); *H01R 43/16* (2013.01)

(58) Field of Classification Search

CPC .... H01R 13/187; H01R 13/113; H01R 24/20; H01R 43/16

USPC ..... 439/843

See application file for complete search history.

(56) References Cited

U.S. PATENT DOCUMENTS

| | | | | |
|---|---|---|---|---|
| 5,408,048 | A * | 4/1995 | Endo | H01R 4/2462 174/74 R |
| 7,594,832 | B2 * | 9/2009 | Oka | H01R 13/03 439/884 |
| 7,713,101 | B2 * | 5/2010 | Oka | H01R 13/20 439/884 |
| 7,766,706 | B2 * | 8/2010 | Kawamura | H01R 13/18 439/839 |
| 7,789,720 | B2 | 9/2010 | Zinn | |
| 8,021,200 | B2 * | 9/2011 | Myer | H01R 13/113 439/857 |
| 8,979,600 | B2 * | 3/2015 | von zur Muehlen | H01H 85/48 439/833 |

(Continued)

FOREIGN PATENT DOCUMENTS

CN 206225646 U * 6/2017

OTHER PUBLICATIONS

Terminal & Connectors Product Catalog Part II, Lear Corporation, Southfield MI, Oct. 1, 2008, pp. 82-85.

*Primary Examiner* — Peter G Leigh

(74) *Attorney, Agent, or Firm* — Billion & Armitage

(57) ABSTRACT

A single-piece high voltage (HV) terminal frame includes a top wall, a bottom wall, and a side wall extending between the top wall and the bottom wall. The top wall includes a first top wall layer and an adjacently located second top wall layer. The side wall includes a first side wall layer and an adjacently located second side wall layer. The bottom wall includes a first bottom wall layer and an adjacently located second bottom wall layer. A single-layer contact spring extends from the first top wall layer, wherein the single-layer contact spring is bent to extend into a space located between the top wall and the bottom wall.

19 Claims, 9 Drawing Sheets

(56) References Cited

U.S. PATENT DOCUMENTS

| | | | | |
|---|---|---|---|---|
| 9,142,902 | B2 | 9/2015 | Glick et al. | |
| 9,153,889 | B2 | 10/2015 | Germ et al. | |
| 9,300,069 | B2 | 3/2016 | Morello et al. | |
| 9,318,829 | B2 * | 4/2016 | Yu | H01R 13/113 |
| 9,537,227 | B1 | 1/2017 | Morello et al. | |
| 10,164,365 | B2 * | 12/2018 | Hashiguchi | H01R 13/187 |
| 10,340,619 | B2 * | 7/2019 | Tsukiyoshi | H01R 13/422 |
| 10,389,055 | B1 | 8/2019 | Lui et al. | |
| 2007/0149050 | A1 * | 6/2007 | Oka | H01R 13/20 439/595 |
| 2009/0247024 | A1 * | 10/2009 | Oka | H01R 13/20 439/884 |
| 2010/0124857 | A1 * | 5/2010 | Kawamura | H01R 13/113 439/816 |
| 2012/0315806 | A1 * | 12/2012 | Myer | H01R 13/113 439/861 |
| 2015/0031249 | A1 * | 1/2015 | Yu | H01R 13/113 439/733.1 |
| 2015/0180175 | A1 * | 6/2015 | Yu | H01R 13/64 439/357 |

* cited by examiner

HIGH VOLTAGE (HV) TERMINAL FRAME AND METHOD OF MANUFACTURING THE SAME

BACKGROUND

The present disclosure is directed to a high voltage terminal frame and in particular to a single piece high voltage terminal frame.

High voltage terminal frames include a rigid outer housing and a more compliant contact spring. Typically, the rigid outer housing is separate from the more compliant contact spring, made of different materials, and requiring assembly at manufacture. This type of HV frame is a two-piece assembly. In some embodiments, a conductive bus bar is crimped to the rigid outer housing, resulting in a three-piece assembly. It would be beneficial to develop a high voltage terminal frame that provides the same functionality but that does not require separate components for the rigid outer housing and the more compliant contact spring.

SUMMARY

According to one aspect, a single-piece high voltage (HV) terminal frame includes a top wall, a bottom wall, and a side wall extending between the top wall and the bottom wall. The top wall includes a first top wall layer and a second top wall layer located adjacent the first top wall layer. The bottom wall includes a first bottom wall layer and a second bottom wall layer located adjacent the first bottom wall layer to form a bottom wall, wherein the bottom wall is located opposite the top wall. The side wall includes a first side wall layer and a second side wall layer located adjacent the first side wall layer. A single-layer contact spring extends from the first top wall layer, wherein the single-layer contact spring is bent to extend into a space located between the top wall and the bottom wall.

According to another aspect, a method of fabricating a single-piece HV terminal frame includes forming a single layer of material in a two-dimensional horizontal plane and then folding the single layer of material to form the single-piece HV terminal frame. The HV terminal frame includes a top wall, a bottom wall, and a side wall extending between the top wall and the bottom wall. The top wall includes a first top wall layer and a second top wall layer located adjacent the first top wall layer. The bottom wall includes a first bottom wall layer and a second bottom wall layer located adjacent the first bottom wall layer. The side wall includes a first side wall layer and a second side wall layer located adjacent the first side wall layer. A single-layer contact spring extending from the first top wall layer, wherein the single-layer contact spring is bent to extend into a space located between the top wall and the bottom wall.

According to another aspect, a high voltage (HV) terminal frame is comprised of a top wall, a bottom wall located opposite the top wall, and a side wall extending between the top wall and the bottom wall. The top wall includes a first top wall layer and a second top wall layer located adjacent the first top wall layer. The bottom wall includes a first bottom wall layer and a second bottom wall layer located adjacent the first bottom wall layer. A single-layer contact spring extends from the first top wall layer, wherein the single-layer contact spring is bent to extend into a space located between the top wall and the bottom wall. In addition, a first conductive bus bar located adjacent to the bottom wall.

DETAILED DESCRIPTION

According to some aspects, the present invention is directed to a high voltage (HV) terminal assembly and in particular to a HV terminal frame. In some embodiments, the HV terminal assembly is fabricated from a single piece of material, wherein complex bending/folding of the material provides an HV terminal frame having double-sided walls forming the rigid housing member of the frame and a single wall member forming the more compliant contact spring.

Figure 1A:
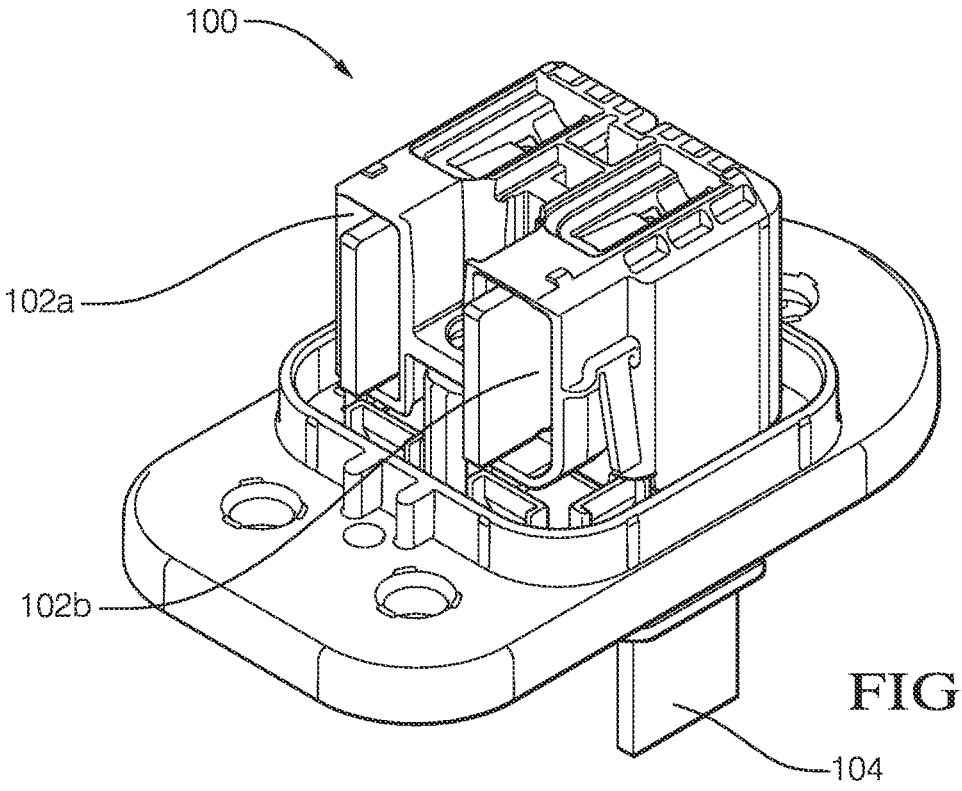
FIG. 1A is an isometric view of a high voltage (HV) terminal assembly according to some embodiments.
Figure 1B:
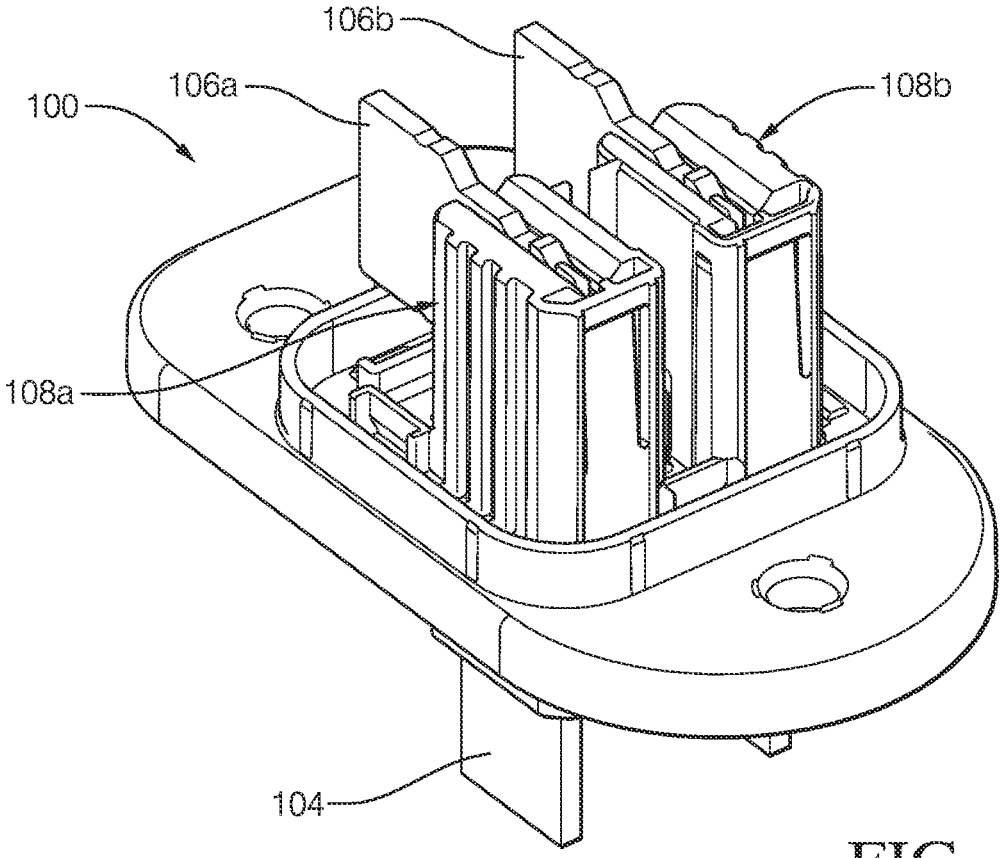
FIG. 1B is an isometric view of a high voltage (HV) terminal assembly with an outer covering removed illustrate a high voltage (HV) terminal frame according to some embodiments.
Figure 1C:
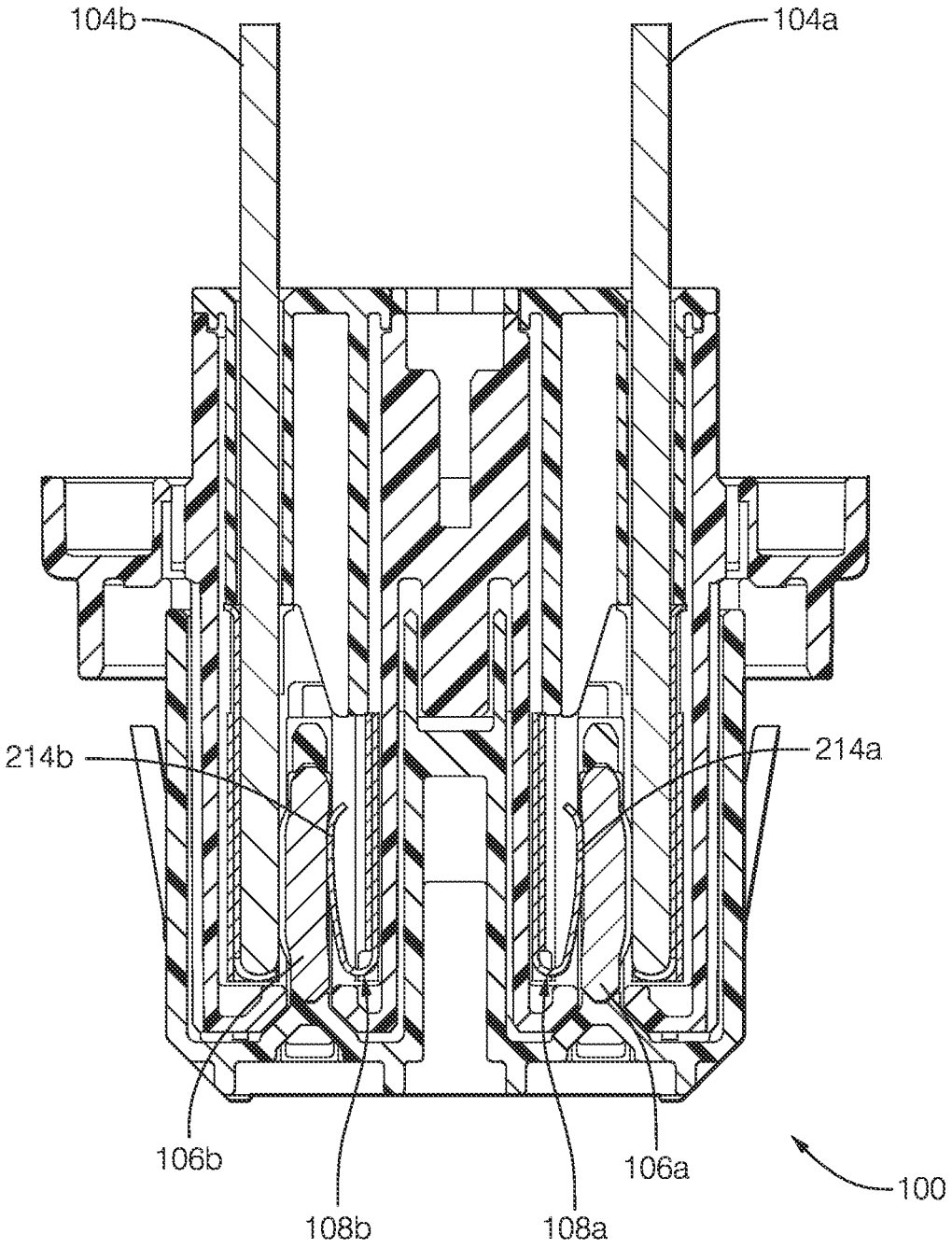
FIG. 1C is a cross-sectional view of a high voltage (HV) terminal assembly according to some embodiments.

Referring now to FIGS. 1A-1C, a HV terminal assembly 100 is provided that utilizes a pair of HV terminal frames 108*a*, 108*b*. In this example, the HV terminal assembly 100 is a right-angle assembly. Terminal ports 102*a*, 102*b* are configured to receive a corresponding terminal (not shown) in a first longitudinal or horizontal direction. A conductive bus bar 104 extends in a vertical direction at a right-angle to the direction of connection associated with the terminal ports 102*a*, 102*b*.

In the embodiment shown in FIG. 1B, a portion of the housing associated with the HV terminal frame 100 is removed to expose the HV terminal frames 108*a*, 108*b*. In this embodiment, a connector side bus bar 106*a*, 106*b* extends longitudinally from the HV terminal frames 108*a*, 108*b*, respectively. Likewise, the header side bus bars 104*a*, 104*b* extend in a downward direction from the HV terminal frames 108*a*, 108*b*. As described in more detail below, in some embodiments the header side bus bars 104*a*, 104*b* are pass through bus bars that do not require crimping of the bus bars to the HV terminal frames 108*a*, 108*b*, respective. In some embodiments, the connector side bus bar 106*a*, 106*b* is slid downward into the HV terminal 108*a*, 108*b*, respectively, and is pressed into contact with the header side bus bars 104*a*, 104*b*, respectively, by contact springs (110*a*, 110*b*, shown in FIG. 1C).

Referring now to FIGS. 2 through 11, various views of the single piece HV terminal frame 108 are provided. In some embodiments, HV terminal frame 108 is fabricated through complex bending of a single sheet of material (shown in FIG. 11) having a uniform thickness. In some embodiments, the material is stainless steel, but other materials may be utilized as well. As a result of the bending operation, some walls of the HV terminal frame 108 are twice as thick as other walls due to the single sheet of material being folded over at some locations. For the purpose of this discussion, walls are labeled 'a' and 'b' to designate the two layers associated with a wall. For example, the top wall 200 includes a first layer 200*a* (first top wall layer 200*a*) and a second layer 200*b* (second top wall layer 200*b*). Likewise, the side wall 202 includes a first layer 202*a* (first side wall layer 202*a*) and a second layer 202*b* (second side wall layer 202*b*), and the bottom wall 204 includes a first layer 204*a* (first bottom wall layer 204*b*) and a second layer 204*b* (second bottom wall layer 204*b*). Other portions of the HV frame 108*a* include only a single layer of material, including guide/retention rail 206, guide arms 208 and 210, forward stop feature 212, contact spring 214, and roll joint 216. Those walls or features comprised of two layers of the material are characterized by increased rigidity as compared with the single layer materials. As a result, the walls or features comprising only a single layer of material are characterized by more compliance or flexibility. In some embodiments, this is beneficial for elements and features such as the contact spring 214. The roll joint 216 represents the location at which the single piece of material is folded back on itself to provide two layers along desired walls. In some embodiments, the curvature of the roll joint 216 is dictated by the material being used to ensure that the roll joint 216 does not crack or break.

Figure 3:
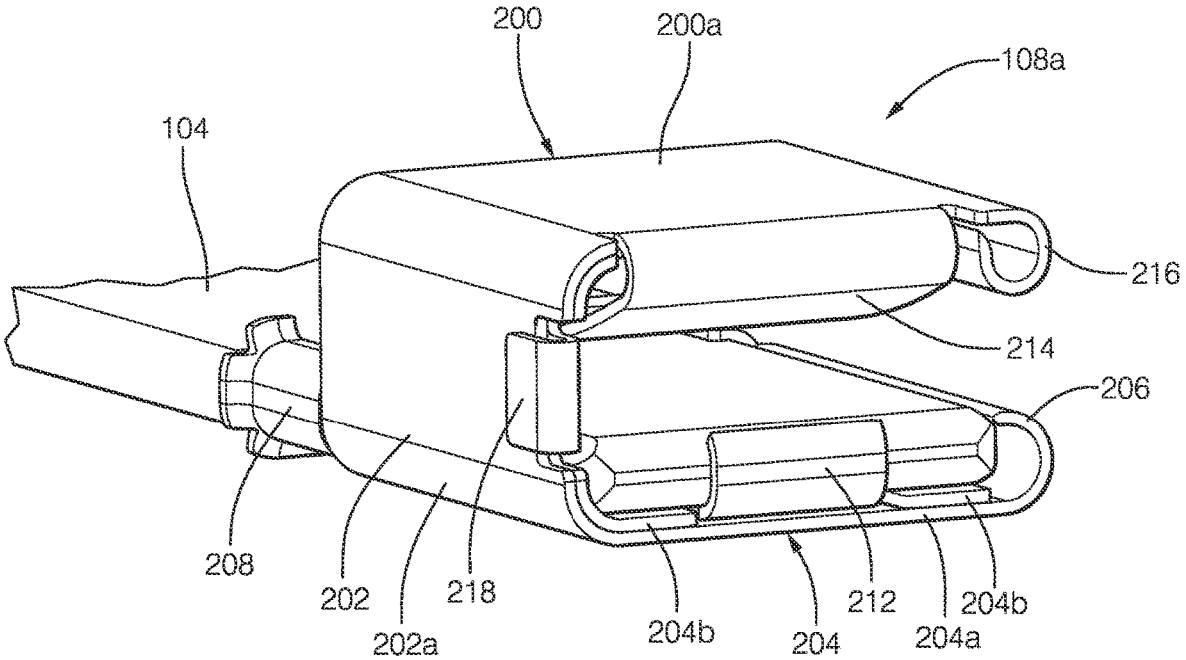
FIG. 3 is a rear isometric view of a high voltage (HV) terminal frame with attached header side bus bar according to some embodiments.

As shown in FIG. 3, the header side bus bar 104 is located adjacent to the bottom wall 204 (in particular, second bottom wall layer 204*b* of the bottom wall 204). In some embodiments, the header side bus bar 104 is a pass-through copper bus bar that extends forward to the forward stop feature 212. In addition, the header side bus bar 104 is retained on a side opposite the side wall 202 by guide/retention rail 206. In some embodiments, guide/retention rail 206 may be a single layer—rather than two layers—as it is not required to provide rigid support. In other embodiments, guide/retention rail 206 may also make use of two layers of material. In some embodiments, guide arms 208 and 210—located opposite one another and extending forward of the bottom wall 204—are utilized to guide the insertion of the header side bus bar 104 into the HV terminal frame 108*a* according to some embodiments. In some embodiments, guide arms 208 and 210 are flared at the ends to simplify insertion of the header side bus bar 104. In some embodiments, the guide arms 208 and 210 are both single layer as they are not required to provide rigidity or support. In other embodiments the guide arms 208 and 210 may be comprised of a double layer if additional rigidity is required.

Figure 2:
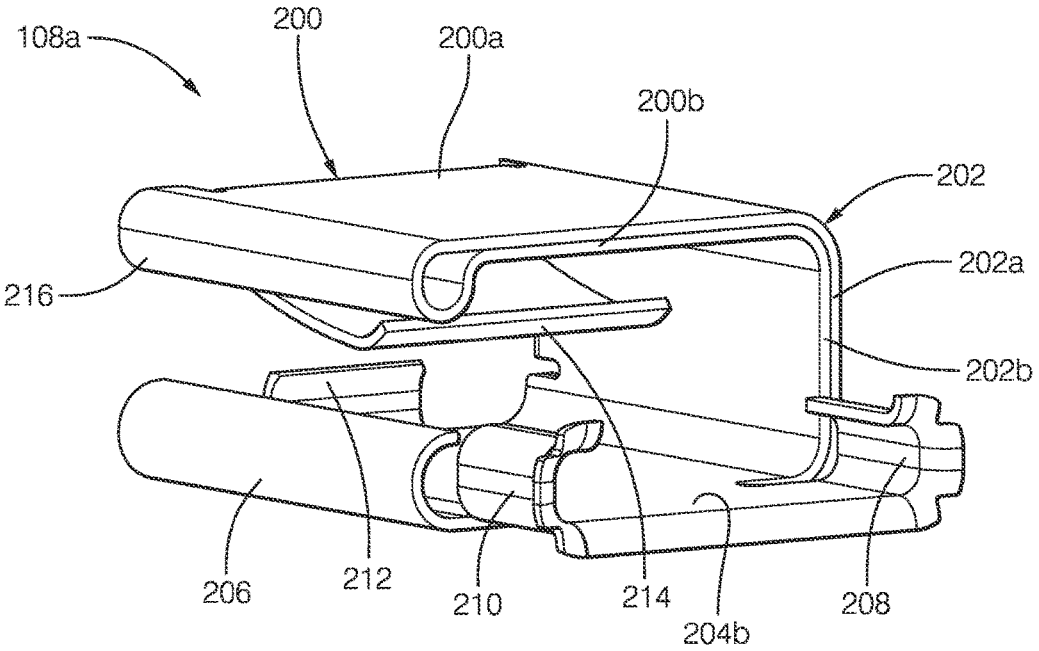
FIG. 2 is a front isometric view of a high voltage (HV) terminal frame according to some embodiments.
Figure 4:
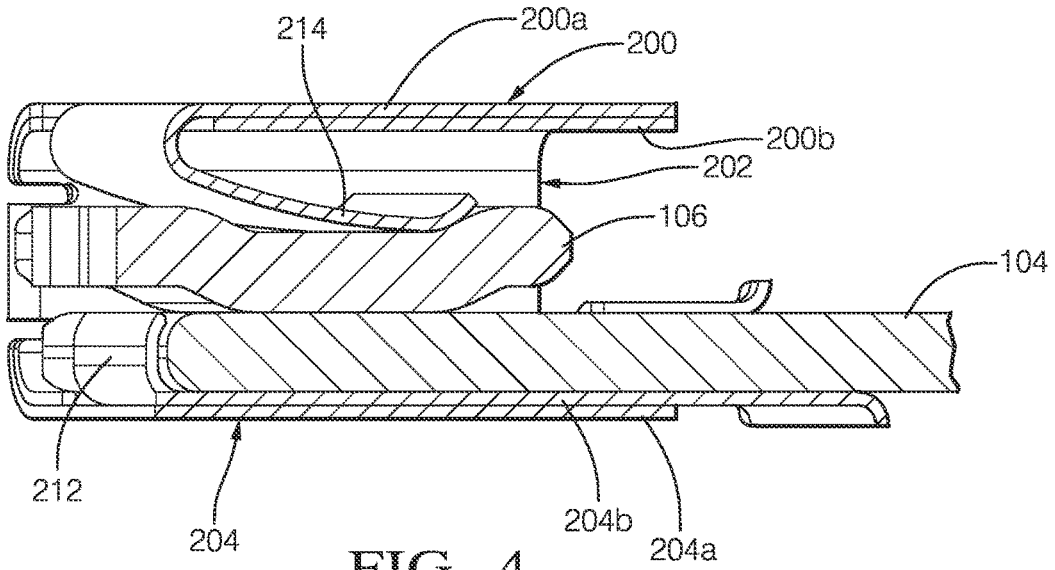
FIG. 4 is a cross-sectional view of a high voltage (HV) terminal frame with attached header side bus bar according to some embodiments.

As shown in the cross-sectional view of FIG. 4, connector side bus bar 106 is inserted into the HV terminal frame 108 and pressed into contact with the header side bus bar 104 by contact spring 214. In some embodiments, the connector side bus bar 106 includes one or more bumps 300 that ensure contact between the connector side bus bar 106 and the header side bus bar 104. In the embodiment shown in FIG. 3, the contact spring 214 generates a normal force (i.e., downward) that presses the connector side bus bar 106 into contact with the header side bus bar 104. Because the contact spring 214 is a single layer of material, the contact spring 214—being more compliant—allows for the contact spring 214 to act as a spring capable of receiving the connector side bus bar. In some embodiments, the contact spring 214 extends from the first top wall layer 200*a* of the top wall 200. As shown in FIGS. 2 and 4, the thickness of the first top wall layer 200*a* is equal to the thickness of the second top wall layer 200*b*. The thickness of the contact spring is equal to the thickness of the second top wall layer 200*b*, and as a result is half the overall thickness of the top wall 200. In this way, the top wall 200 provides rigidity as a result of the overall thickness of the top wall and the contact spring 214 provides the desired springiness or compliance as a result of the single layer thickness.

Figure 5:
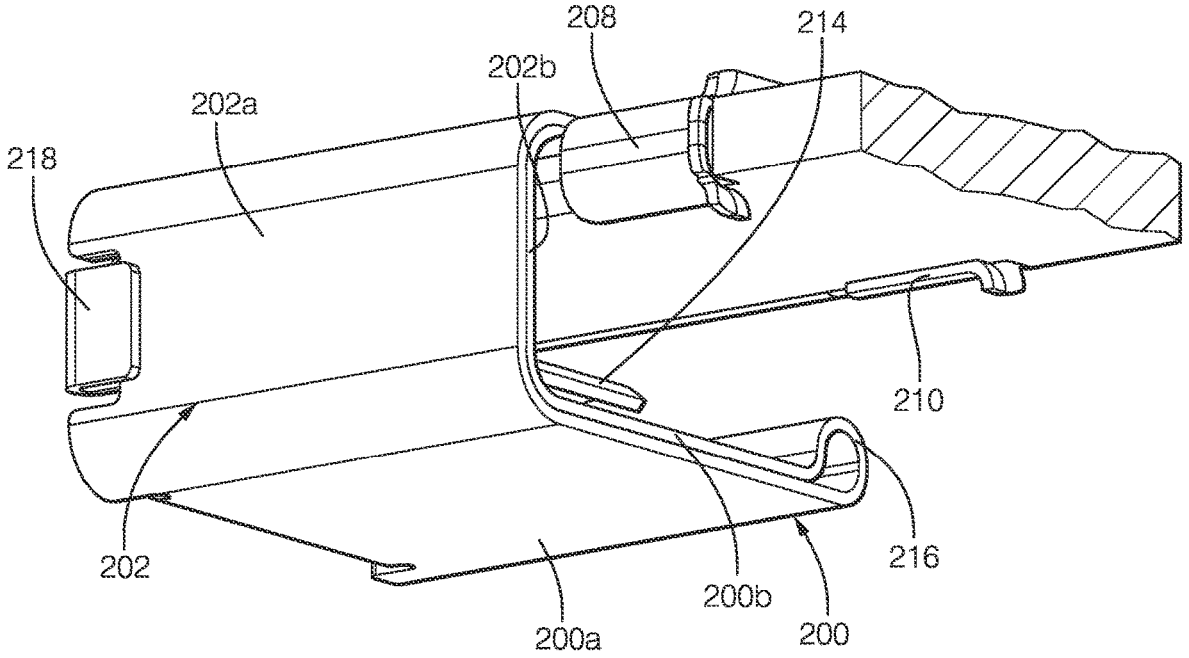
FIG. 5 is an isometric view of a high voltage (HV) terminal frame with attached header side bus bar according to some embodiments.

As shown in FIG. 5, the header side bus bar 104 is retained by the guide arms 208 and 210. In some embodiments, guide arms 208 and 210 are U-shaped and act to retain the header side bus bar 104 on three sides. In other embodiments, guide arms 208 and 210 may be L-shaped, providing support to the header side bus bar 104 on two sides. In addition, in some embodiments a single layer tab 218 extends from the second side wall layer 202*b* and wraps around the outer side wall layer 202*a*. In some embodiments, the single layer tab 218 acts to secure the first side wall layer 202*a* to the second side wall layer 202*b*—preventing the side wall layers as well as the other layers from pulling apart from one another.

Figure 6:
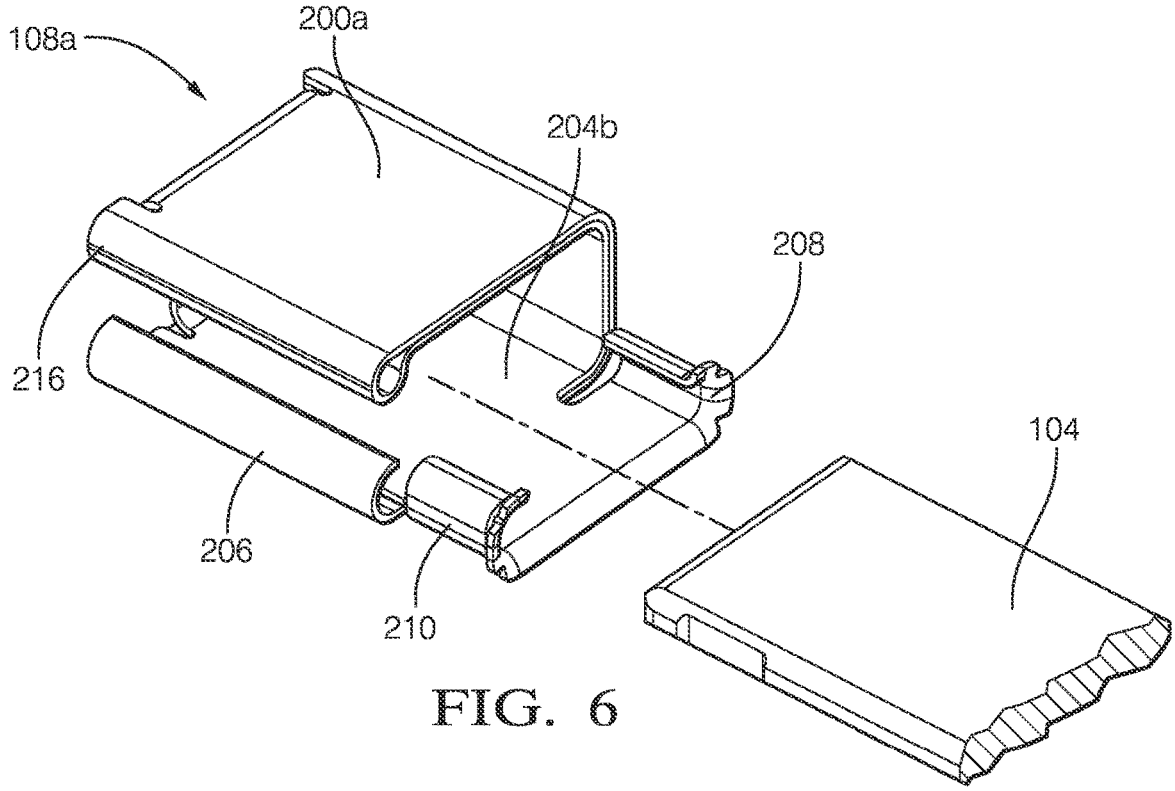
FIG. 6 is an isometric view illustrating insertion of a header side bus bar into a high voltage (HV) terminal frame according to some embodiments.
Figure 7:
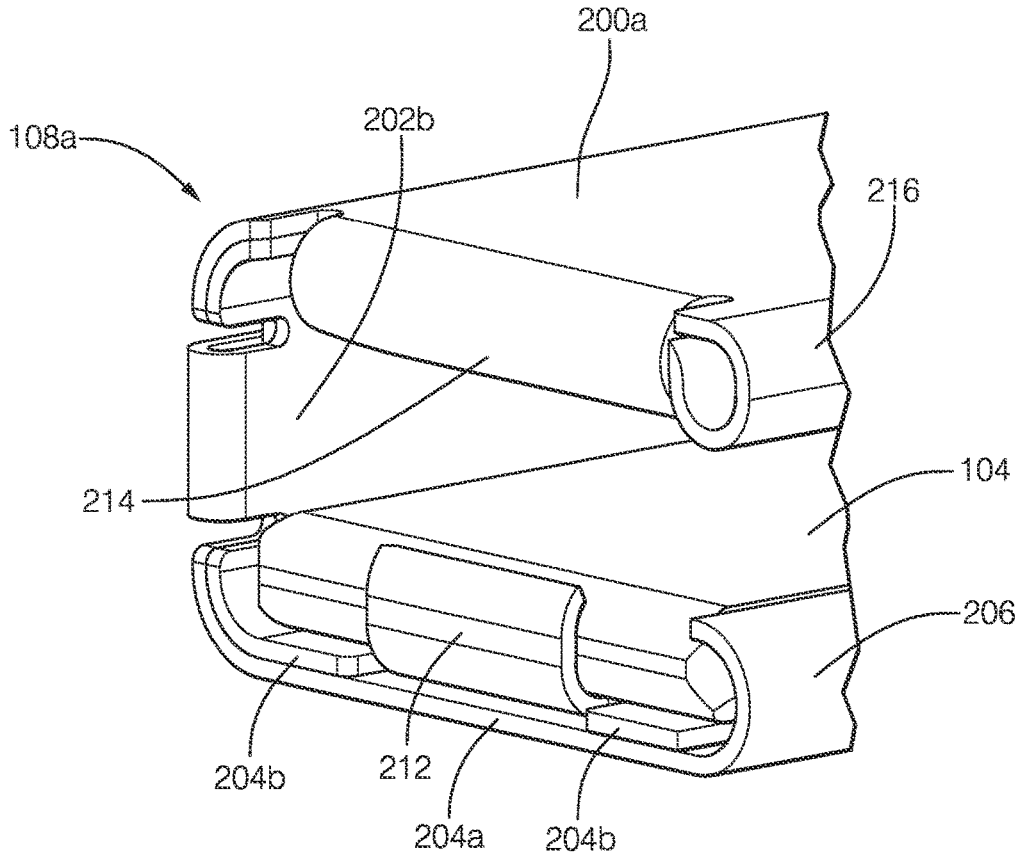
FIG. 7 is a magnified isometric view of the header side bus bar connected to the high voltage (HV) terminal frame according to some embodiments.

Referring now to FIGS. 6 and 7, the insertion of the header side bus bar 104 bar is shown. In particular, in the embodiment shown in FIG. 6 the header side bus bar 104 is shown being inserted into the HV terminal frame 108. In some embodiments, guide arms 208 and 210 capture the header side bus bar 104 and guide the insertion of the header side bus bar 104 into place against the forward stop feature 212. As shown in FIG. 7, the forward stop feature 212 prevents the header side bus bar 104 from extending beyond the HV terminal frame 108. In some embodiments, the forward stop feature 212 is a single layer feature that extends from second bottom wall layer 204*b* of the bottom wall 204. In some embodiments, the header side bus bar 104 is not crimped or otherwise secured to the HV terminal frame 108. That is, in some embodiments the header side bus bar 104 is a pass through bus bar. In some embodiments, the header side bus bar 104 is secured within the housing of the HV terminal assembly 100 (shown in FIG. 1A).

Figure 8:
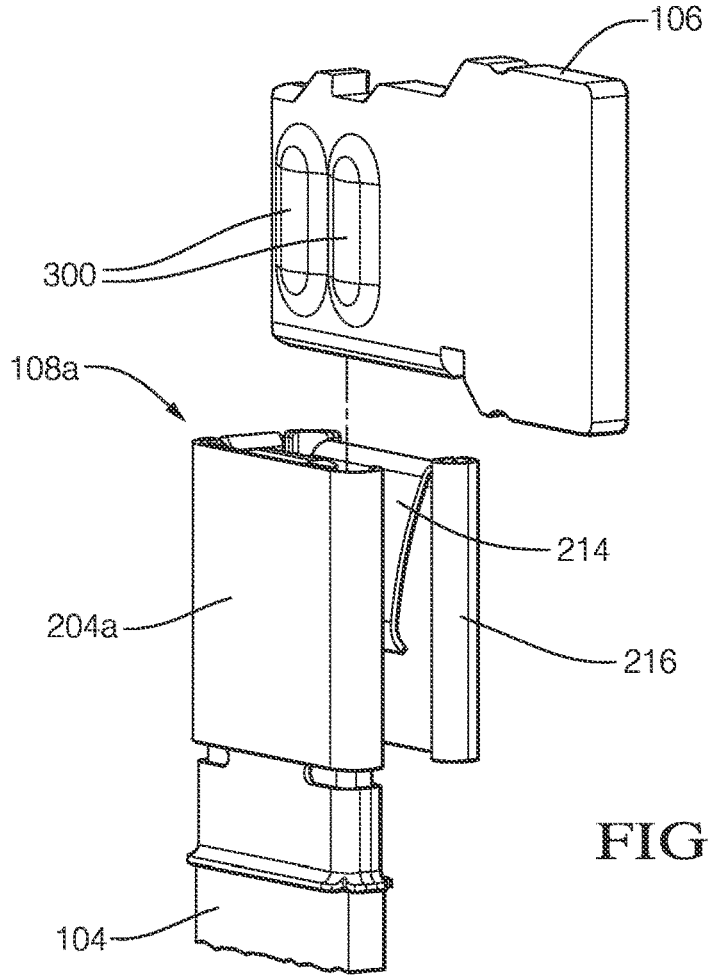
FIG. 8 is an isometric view of a high voltage (HV) terminal frame illustrating connection of a connector side bus bar according to some embodiments.
Figure 9:
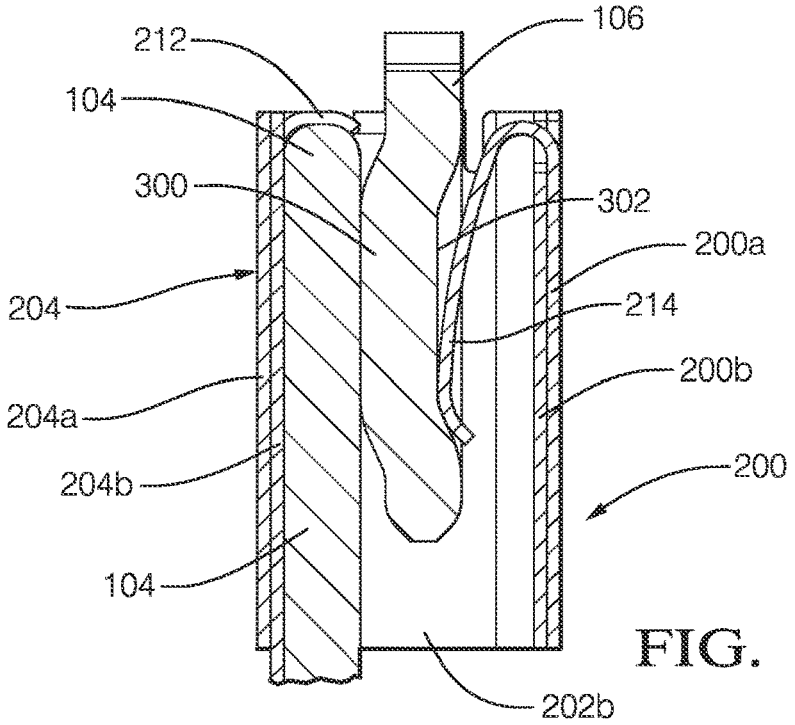
FIG. 9 is a cross-sectional view illustrating retention of a connector side bus bar and header side bus bar within a high voltage (HV) terminal frame according to some embodiments.
Figure 10:
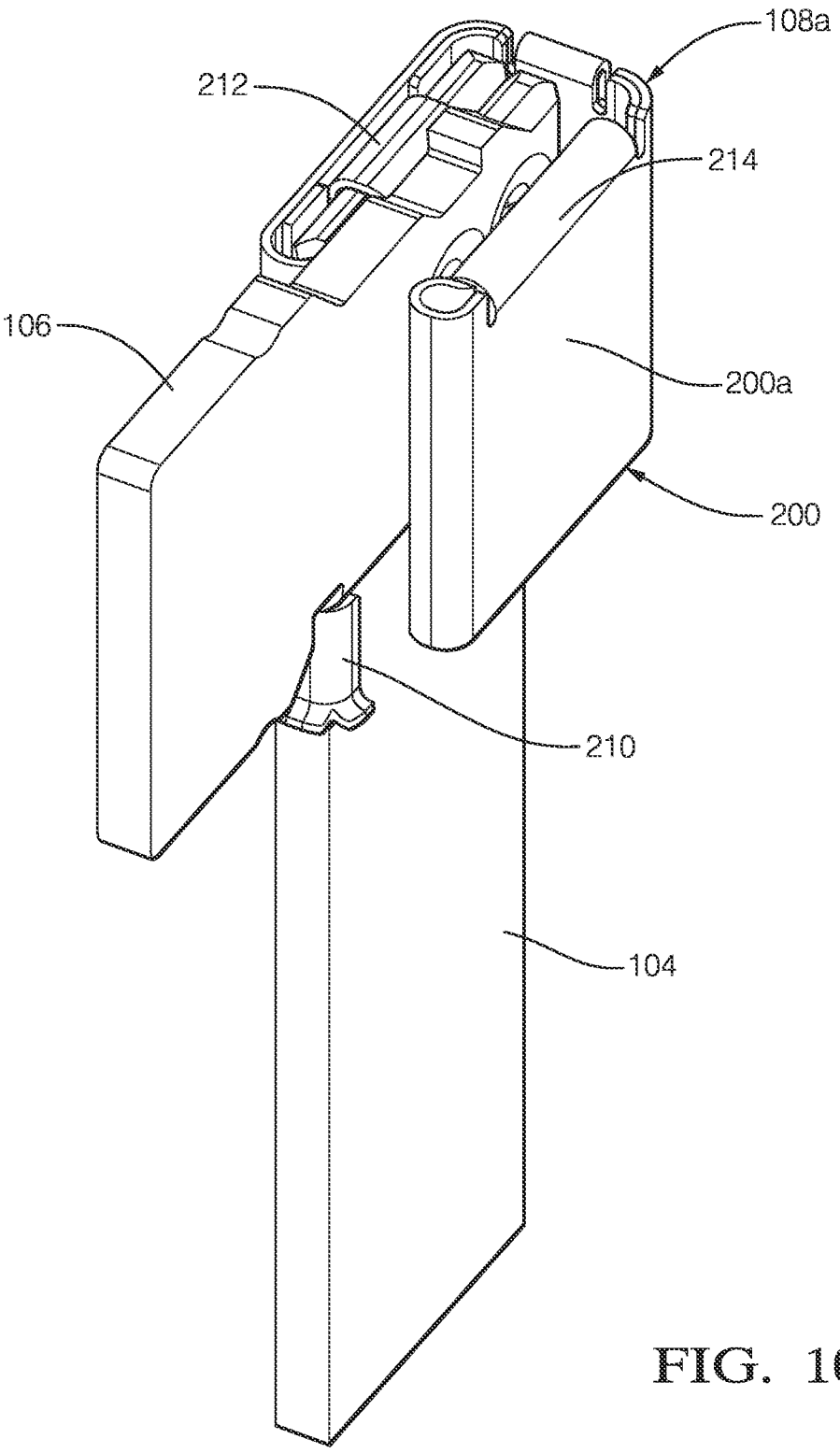
FIG. 10 is an isometric view illustrating a high voltage (HV) terminal having a connector side bus bar and header side bus bar extending therefrom according to some embodiments.

Referring now to FIGS. 8-10, the insertion of the connector side bus bar 106 into the HV terminal frame 108*a* is shown. As shown in FIG. 8, the direction of the arrow illustrates the direction of insertion of the connector side bus bar 106. The connector side bus bar 106 is slid into the HV terminal frame 108. A first side of the connector side bus bar 106 (not visible) comes into contact with the contact spring 214. The opposite side of the connector side bus bar 106 includes first and second bumps 300 that are brought into contact with the header side bus bar 104 (already inserted into the HV terminal frame 108). The contact spring 214 acts to generate a normal force on the connector side bus bar 106 that forces the connector side bus bar 106 into contact with the header side bus bar 104. In this embodiment, the header side bus bar 104 extends in a first direction along the longitudinal axis of the HV terminal frame 108*a*, and connector side bus bar 106 extends at an angle of approximately 90° relative to the header side bus bar 104.

In the cross-sectional view shown in FIG. 9, contact spring 214 is shown in in contact with the connector side bus bar 106. In some embodiments, connector side bus bar 106 includes features for receiving the contact spring 214 (e.g., an indentation or groove 302). When fully inserted, the contact sprig 214 is captured within the indentation 302 and prevents pull out of the connector side bus bar 106.

As shown in FIG. 10, the connector side bus bar 106 is fully inserted within the HV terminal frame 108*a* and in contact with the header side bus bar 104. As discussed above, the HV terminal frame 108*a* forms a right-angle connection between the respective bus bars. Header side bus bar 104 is a pass through bus bar retained within the HV terminal frame 108*a* by guide arms 208 and 210 and forward stop feature 212, and connector side bus bar 104 is forced into contact with the header side bus bar 104. In some embodiments the header side bus bar 104 is positioned at a right angle to the connector side bus bar 106. In other embodiments, however, the HV terminal frame 108*a* is also capable of accepting bus bars that are axial or in-line with one another—rather than at a right angle—with no change to the structure of the HV terminal frame 108*a*.

Figure 11:
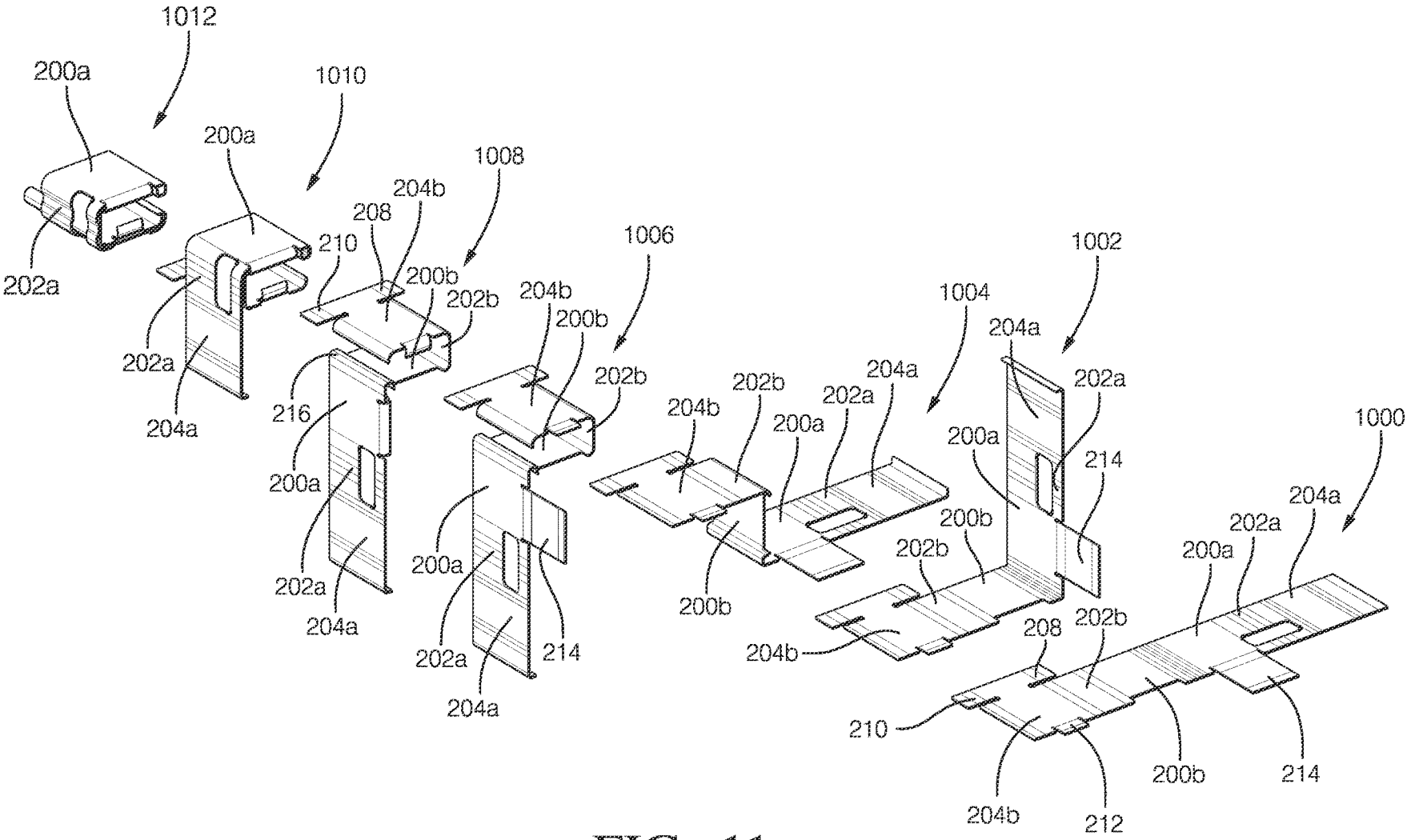
FIG. 11 is an isometric view illustrating the folding of a single piece of material to form a high voltage (HV) terminal frame according to some embodiments.

FIG. 11 is a diagram illustrating the complex folding of a single layer into the HV terminal frame 108*a*. At step 1000, a single layer of material is provided. As a discussed above, in some embodiments, the single layer of material is stainless steel having a uniform thickness. In some embodiments, other materials may be utilized. In some embodiments, the geometry shown at step 1000 is created through a stamping process. For the sake of clarity, the various walls are labeled according to their eventual location as part of the HV terminal frame 108*a*. Starting at the top of the single piece and moving downward is the first bottom wall layer 204*a* of the bottom wall 204, the first side wall layer 202*a* of the side wall 202, the first top wall layer 200*a* of the top wall 200, the second top wall layer 200*b* of the top wall 200, the second side wall layer 202*b* of the side wall 200, and the second bottom wall layer 204*b* of the bottom wall 204. Extending from the first top wall layer 200*a* is the contact spring 214 and extending from the second bottom wall layer 204*b* are guide arms 208 and 210 and forward stop 212.

At step 1002, a first bend between the first side wall layer 202*a* and the second side wall layer 202*b* is provided. As a result, first top wall layer 204*a*, first side wall layer 202*a*, and first top wall layer 200*a* are oriented vertically. At step 1004, the frame is rotated 90° so that the first bottom wall layer 204*a*, the first side wall layer 202*a*, and the first top wall layer 200*a* are oriented horizontally. A second bend is formed between the second top wall layer 200*b* and the second side wall layer 202*b*. As a result, the first top wall layer 200*b* is oriented vertically and the second side wall layer 202*b* and second bottom wall layer 204*b* are oriented horizontally.

At step 1006, a third bend is formed between the second bottom wall layer 204*b* and the second side wall layer 202*b* (with the second bottom wall layer 204*b* remaining motionless in this step). In addition, side rail 206 extending from the second bottom wall layer 204*b* is bent to provide the desired geometry. At step 1008, the forward stop feature 212 is bent as desired to provide the desired geometry of the stop feature. Likewise, the contract spring 214 is bent to provide the desired geometry of the contract spring 214.

At step 1010, the product is rotating 180° and a fourth bend is formed between the first top wall layer 200*a* and curved portion 216 and a fifth bend is formed between the first top wall layer 200*a* and the first side wall layer 202*a*. As a result, the first top wall layer 200*a* is located adjacent to the second top wall layer 200*b* to form the two layer top wall 200 and the first side wall layer 202*a* is located adjacent to the second side wall layer 202*b* to form the two-layer side wall 202.

At step 1012, a sixth bend is formed between the first side wall layer 202*a* and the first bottom wall layer 204*a*. As a result, the first bottom wall layer 204*a* is brought into contact with the second bottom wall layer 204*b* to form the two layer bottom wall 204. In addition, at step 1012 the guide arms 208 and 210 extending from the second bottom wall layer 204*b* are bent to form the desired geometry. In this way, a single layer of material (stamped or otherwise cut to provide the desired geometry) is bent through a series of actions to provide the desired HV terminal frame 108*a* geometry. In particular, the steps shown in FIG. 11 provide an HV terminal frame geometry having the desired characteristics, including rigid walls and flexible or at least more compliant contact spring and guide arms. Benefits include relatively inexpensive manufacturing costs while maintaining the desired characteristics of the HV terminal frame.

In some embodiments, the HV terminal frame 108*a* is fabricated as shown in FIG. 11 through the series of bending steps without more. However, in some embodiments post-processing of the HV terminal frame 108*a* may be utilized to provide additional rigidity to the walls (e.g., one or more of the top wall 200, side wall 202, and bottom wall 204) of the HV terminal frame 108*a*. In some embodiments, additional rigidity is provided by welding respective layers together to prevent movement between the respective layers. For example, in some embodiments the first top wall layer 200*a* and the second top wall layer 200*b* are welded together to provide additional rigidity to the top wall 200. In some embodiments, the respective layers are spot welded. In other embodiments the respective layers are laser welded. Likewise, welding may be provided between first side wall layer 202*a* and second side wall layer 202*b* and between first bottom wall layer 204*a* and second bottom wall layer 204*b*. The purpose of the welding is to prevent movement of the respective layers (e.g., first top wall layer 200*a* and second top wall layer 200*b*) relative to one another. This increases the overall rigidity of the top wall 200 of the HV terminal frame 108*a* without changing the compliance features of the contact spring 214. In addition to utilizing techniques to adhere the respective layers to one another (e.g., welding, adhesives, etc.), in other embodiments one or more stamping features (features fabricated using a stamping process or a similar process) may be utilized to prevent movement between the respective layers and increase the overall rigidity of the walls (e.g., top wall, side wall, and/or bottom wall) of the HV terminal frame 108*a*, as shown in FIGS. 12 and 13, described below.

Figure 12:
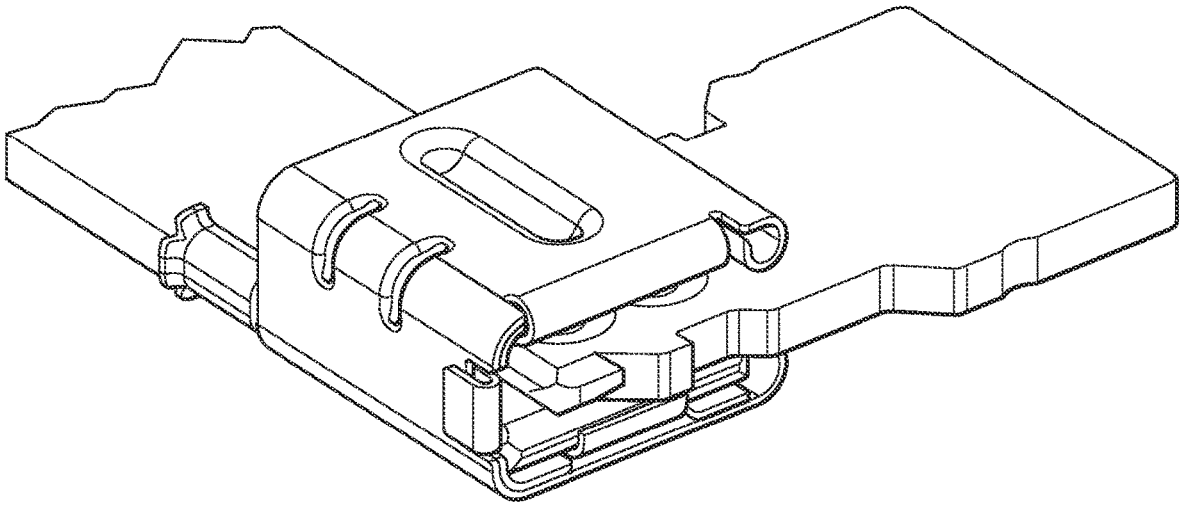
FIG. 12 is an isometric view of a high voltage (HV) terminal frame utilizing rib and/or gusset features according to some embodiments.
Figure 13:
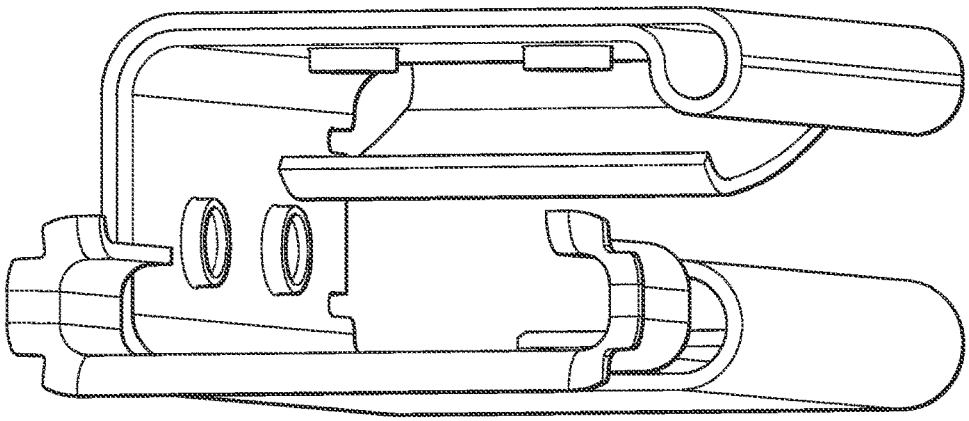
FIG. 13 is an isometric view of a high voltage (HV) terminal frame utilizing a clinch pin feature according to some embodiments.

Referring now to FIGS. 12 and 13, various stamping features are illustrated for providing additional rigidity between layers making up one or more of the walls. In the embodiment shown in FIG. 12, the HV terminal frame 108*a* FIG. 12 is an isometric view of a high voltage (HV) terminal frame utilizing rib and/or gusset features according to some embodiments. As discussed above, the top wall 200, side wall 202 and bottom wall 204 are each comprised of a first layer and a second layer. For example, the top wall 200 is comprised of a first top wall layer 200*a* and a second top wall layer 200*b*. As shown in FIG. 11, the HV terminal frame 108*a* is fabricated through the complex bending of a single layer of material, resulting in layers of the material being located adjacent to each other (e.g., first top wall layer 200*a*, second top wall layer 200*b*). In some embodiments, to further increase rigidity of the walls, one or more of the features shown in FIGS. 12 and 13 may be utilized. In part, these features act to prevent the respective layers from moving relative to one another. For example, in the embodiment shown in FIG. 12 a rib feature 1200 is formed on the top wall 200. In this embodiment, the rib feature 1200 is an oval shaped indentation formed in both the first top wall layer 200*a* and the second top wall layer 200*b* that prevents the first top wall layer 200*a* and the second top wall layer 200*b* from moving relative to one another. In other embodiments, the rib feature 1200 may alternatively or in addition be formed in the side wall 202 and/or the bottom wall 204. In addition, although the rib feature 1200 shown in FIG. 12 is oval in shape, in other embodiments other geometries may be utilized. Importantly, rather than the first top wall layer 200*a* and second top wall layer 200*b* being planar relative to one another, the rib feature 1200 creates a non-planar region that prevents movement of the respective layers relative to one another and therefore increases rigidity of the top wall 200 (as well as the overall rigidity of the HV terminal frame 108*a*).

In some embodiments, the HV terminal frame 108*a* may either in addition or separately include one or more gusset features 1202*a*, 1202*b*. In some embodiments, the gusset features 1202*a*, 1202*b* are formed in the transition region 1204 between the top wall 1200 and the side wall 1202. The gusset features 1202*a*, 1202*b* act to provide additional reinforcement/support to the transition region 1204 located between the top wall 200 and the side wall 202. In other embodiments, gusset features may also be located in the transition region 1206 between the side wall 202 and the bottom wall 204.

In addition to providing support to the transition region 1206, the gusset features 1202*a*, 1202*b* formed in the first and second layers of material act to prevent the layers from moving relative to one another similar to the support provided by the rib feature 1200. That is, instead of the first and second layers being adjacent to one another in a plane, the gusset features 1202*a*, 1202*b* provides a non-planar region that prevents the respective layers from sliding relative to one another.

In some embodiments, the rib feature 1200 is fabricated using a press operation after the first top wall layer 200*a* and the second top wall layer 200*b* are brought together. In some embodiments, fabrication of the rib feature 1200 is performed after folding of the single sheet to form the HV terminal frame 108*a*. In other embodiments, fabrication of the rib feature 1200 is performed during folding of the single sheet to form the HV terminal frame 108*a* after the first top wall layer 200*a* and the second top wall layer 200*b* are brought into contact with one another. Likewise, the gusset features 1202*a*, 1202*b* may be fabricated using a press operation after the first top wall layer 200*a* and the second top wall layer 200*b* as well as the first side wall layer 202*a* and the second side wall layer 202*b* have been brought together. In some embodiments, the fabrication of the gusset features 1202*a*, 1202*b* is performed after folding the single sheet to form the HV terminal frame 108*a*. In other embodiments, the gusset features 1202*a*, 1202*b* may be formed as soon as the top wall 1200 and the side wall 1202 have been formed. Likewise, if the gusset feature is formed in the transition region 1206 between the side wall 202 and the bottom wall 204, the feature may be formed as soon as the first side wall layer 202*a* and second side wall layer 202*b* and first bottom wall layer 204*a* and second bottom wall layer 204*b* are brought together.

In the embodiment shown in FIG. 13, additional rigidity is provided to the HV terminal frame 1208*a* through the addition of clinch pin features 1300*a*, 1300*b* formed in the top wall 200 and clinch pin features 1302*a*, 1302*b* formed in the side wall 202. Likewise, the second clinchIn some embodiments, the clinch pin feature In part, these features act to prevent the respective layers from moving relative to one another. For example, in the embodiment shown in FIG. 12 a rib feature 1200 is formed on the top wall 200. In this embodiment, the rib feature 1200 is an oval shaped indentation formed in both the first top wall layer 200*a* and the second top wall layer 200*b* that prevents the first top wall layer 200*a* and the second top wall layer 200*b* from moving relative to one another. In other embodiments, the rib feature 1200 may alternatively or in addition be formed in the side wall 202 and/or the bottom wall 204. In addition, although the rib feature 1200 shown in FIG. 12 is oval in shape, in other embodiments other geometries may be utilized. Importantly, rather than the first top wall layer 200*a* and second top wall layer 200*b* being planar relative to one another, the rib feature 1200 creates a non-planar region that prevents movement of the respective layers relative to one another and therefore increases rigidity of the top wall 200 (as well as the overall rigidity of the HV terminal frame 108*a*).

FIG. 13 is an isometric view of a high voltage (HV) terminal frame utilizing a first clinch pin feature 1300*a*, 1300*b* and a second clinch pin feature 1302*a*, 1302*b* according to some embodiments. In the embodiment shown in FIG. 13, first clinch pin features 1300*a*, 1300*b* are formed in the top wall 200. As discussed above with respect to the rib feature and gusset features shown in FIG. 12, the first clinch pin features 1300*a*, 1300*b* are formed in the first top wall layer 200*a* and the second top wall layer 200*b*. Likewise, the second clinch pin features 1302*a*, 1302*b* are formed in the first side wall layer 202*a* and the second side wall layer 202*b*. In addition, in some embodiments, the bottom wall 204 may also include clinch pin features, either alone or in combination with the clinch pin features utilized on the top wall 200 and the side wall 202. These features act to prevent the respective layers from moving relative to one another. Importantly, rather than the first top wall layer 200*a* and second top wall layer 200*b* being planar relative to one another, the clinch pin features 1300*a*, 1300*b* creates a non-planar region that prevents movement of the respective layers relative to one another and therefore increases rigidity of the top wall 200 (as well as the overall rigidity of the HV terminal frame 108*a*).

In some embodiments, the clinch pin features 1300*a*, 1300*b* (as well as clinch pin features 1302*a*, 1302) are fabricated using a pressing operation after the respective layers (e.g., first top wall layer 200*a* and second top wall layer 200*b*) are brought into contact with one another. In some embodiments, the first clinch pin features 1300*a*, 1300*b* are formed after the HV terminal frame 108*a* is fabricated. In other embodiments, the first clinch pin features 1300*a*, 1300*b* may be fabricated as soon as the first top wall layer 200*a* and the second top wall layer 200*b* are located adjacent to one another. Likewise, the second clinch pin features 1302*a*, 1302*b* may be fabricated as soon as the first side wall layer 202*a* and the second side wall layer 202*b* are located adjacent to one another.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

According to one aspect, a single-piece high voltage (HV) terminal frame includes a top wall, a bottom wall, and a side wall extending between the top wall and the bottom wall. The top wall includes a first top wall layer and a second top wall layer located adjacent the first top wall layer. The bottom wall includes a first bottom wall layer and a second bottom wall layer located adjacent the first bottom wall layer to form a bottom wall, wherein the bottom wall is located opposite the top wall. The side wall includes a first side wall layer and a second side wall layer located adjacent the first side wall layer. A single-layer contact spring extends from the first top wall layer, wherein the single-layer contact spring is bent to extend into a space located between the top wall and the bottom wall.

The single-piece HV terminal frame of the preceding paragraph can optionally include, additionally and/or alternatively any, one or more of the following features, configurations, and/or additional components.

For example, in some embodiments, the single-piece HV terminal frame may include a forward stop feature extending from a forward side of the second bottom wall layer and positioned to act as a stop to a bus bar received by the single-piece HV terminal frame.

In some embodiments, the single-piece HV terminal frame may include a guide rail extending from a first side of the second bottom wall layer, the guide rail positioned to guide a bus bar received by the single-piece HV terminal frame.

In some embodiments, the single-piece HV terminal frame may include first and second guide arms extending from a rear side of the second bottom wall layer, wherein the first and second guide arms are positioned to guide a bus bar received by the single-piece HV terminal frame.

In some embodiments, the single-piece HV terminal frame is fabricated from a single, continuous layer of material bent to form the desired geometry of the single-piece HV terminal frame.

In some embodiments, the single-piece HV terminal frame is fabricated from a single, continuous layer of stainless steel.

In some embodiments, the single-piece HV terminal frame includes one or more stamping features fabricated on one or more of the top wall, the side wall or the bottom wall.

According to another aspect, a method of fabricating a single-piece HV terminal frame includes forming a single layer of material in a two-dimensional horizontal plane and then folding the single layer of material to form the single-piece HV terminal frame. The HV terminal frame includes a top wall, a bottom wall, and a side wall extending between the top wall and the bottom wall. The top wall includes a first top wall layer and a second top wall layer located adjacent the first top wall layer. The bottom wall includes a first bottom wall layer and a second bottom wall layer located adjacent the first bottom wall layer. The side wall includes a first side wall layer and a second side wall layer located adjacent the first side wall layer. A single-layer contact spring extending from the first top wall layer, wherein the single-layer contact spring is bent to extend into a space located between the top wall and the bottom wall.

The method of the preceding paragraph can optionally include, additionally and/or alternatively any, one or more of the following features, configurations, and/or additional components.

For example, in some embodiments the step of forming the single layer of material in a two-dimensional horizontal plane includes cutting the material in a desired geometry.

In some embodiments, the single-layer of material is cut using a punch operation.

In some embodiments, the single-layer of material is stainless steel.

In some embodiments, the method further includes welding one or more of the first top wall layer to the second top wall layer, the first side wall layer to the second side wall layer, or the first bottom wall layer to the second bottom wall layer.

In some embodiments, the method further includes fabricating one or more stamping features on the HV terminal frame, wherein the stamping features are located on one or more of the top wall, the side wall, the bottom wall, and/or on transition regions located between the top wall and the side wall and between the side wall and the bottom wall.

According to another aspect, a high voltage (HV) terminal frame is comprised of a top wall, a bottom wall located opposite the top wall, and a side wall extending between the top wall and the bottom wall. The top wall includes a first top wall layer and a second top wall layer located adjacent the first top wall layer. The bottom wall includes a first bottom wall layer and a second bottom wall layer located adjacent the first bottom wall layer. A single-layer contact spring extends from the first top wall layer, wherein the single-layer contact spring is bent to extend into a space located between the top wall and the bottom wall. In addition, a first conductive bus bar located adjacent to the bottom wall.

The HV terminal frame of the preceding paragraph can optionally include, additionally and/or alternatively any, one or more of the following features, configurations, and/or additional components.

For example, in some embodiments the HV terminal frame may include a forward stop feature extending from a forward side of the second bottom wall layer and positioned to act as a stop to the first conductive bus bar.

In some embodiments, the HV terminal frame may include a guide rail extending from a first side of the second bottom wall layer, the guide rail positioned to retain the first conductive bus bar on a side opposite the side wall.

In some embodiments, the HV terminal frame includes first and second guide arms extending from a rear side of the second bottom wall layer, wherein the first and second guide arms retain the first conductive bar.

In some embodiments, the top wall, the side wall, the bottom wall and contact spring are formed from a single, continuous piece of material folded to the desired shape.

In some embodiments, the HV terminal frame further includes a second conductive bus bar received by the HV terminal frame, wherein the second conductive bus bar is forced into contact with the first conductive bus bar by the contact spring.

In some embodiments, the HV terminal frame further includes one or more stamping features located on one or more of the top wall, the side wall, the bottom wall, a transition region between the top wall and the side wall, and a transition region between the side all and the bottom wall.

The invention claimed is:

1. A single-piece high voltage (HV) terminal frame comprising:

a first top wall layer and a second top wall layer located adjacent the first top wall layer to form a top wall;

a first bottom wall layer and a second bottom wall layer located adjacent the first bottom wall layer to form a bottom wall, wherein the bottom wall is located opposite the top wall;

a first side wall layer and a second side wall layer located adjacent the first side wall layer to form a side wall, wherein the side wall extends between the top wall and the bottom wall; and a single-layer contact spring extending from the first top wall layer, wherein the single-layer contact spring is bent to extend into a space located between the top wall and the bottom wall, wherein the single-piece HV terminal frame is fabricated from a single, continuous layer of material bent to form the desired geometry of the single-piece HV terminal frame.

2. The single-piece HV terminal frame of claim 1, further including:

a forward stop feature extending from a forward side of the second bottom wall layer and positioned to act as a stop to a bus bar received by the single-piece HV terminal frame.

3. The single-piece HV terminal frame of claim 2, further including:

a guide rail extending from a first side of the second bottom wall layer, the guide rail positioned to guide a bus bar received by the single-piece HV terminal frame.

4. The single-piece HV terminal frame of claim 3, further including:

first and second guide arms extending from a rear side of the second bottom wall layer, wherein the first and second guide arms are positioned to guide a bus bar received by the single-piece HV terminal frame.

5. The single-piece HV terminal frame of claim 1, wherein the single, continuous layer of material is stainless steel.

6. The single-piece HV terminal frame of claim 1, further including one or more stamping features fabricated on one or more of the top wall, the side wall or the bottom wall.

7. A method of fabricating a single-piece HV terminal frame, the method comprising:

forming a single layer of material in a two-dimensional horizontal plane; and folding the single layer of material to form the single-piece HV terminal frame, wherein the HV terminal frame comprises:

a first top wall layer and a second top wall layer located adjacent the first top wall layer to form a top wall;

a first bottom wall layer and a second bottom wall layer located adjacent the first bottom wall layer to form a bottom wall, wherein the bottom wall is located opposite the top wall;

a first side wall layer and a second side wall layer located adjacent the first side wall layer to form a side wall, wherein the side wall extends between the top wall and the bottom wall; and a single-layer contact spring extending from the first top wall layer, wherein the single-layer contact spring is bent to extend into a space located between the top wall and the bottom wall.

8. The method of claim 7, wherein the step of forming the single layer of material in a two-dimensional horizontal plane includes cutting the material in a desired geometry.

9. The method of claim 7, wherein the step of forming the single layer of material in a two-dimensional horizontal plane includes applying a punch operation to cut the material in a desired geometry.

10. The method of claim 7, wherein the single-layer of material is stainless steel.

11. The method of claim 7, further including:

welding one or more of the first top wall layer to the second top wall layer, the first side wall layer to the second side wall layer, or the first bottom wall layer to the second bottom wall layer.

12. The method of claim 7, further including:

fabricating one or more stamping features on the HV terminal frame, wherein the stamping features are located on one or more of the top wall, the side wall, the bottom wall, and/or on transition regions located between the top wall and the side wall and between the side wall and the bottom wall.

13. A high voltage (HV) terminal frame comprising:

a first top wall layer and a second top wall layer located adjacent the first top wall layer to form a top wall;

a first bottom wall layer and a second bottom wall layer located adjacent the first bottom wall layer to form a bottom wall, wherein the bottom wall is located opposite the top wall;

a first side wall layer and a second side wall layer located adjacent the first side wall layer to form a side wall, wherein the side wall extends between the top wall and the bottom wall;

a single-layer contact spring extending from the first top wall layer, wherein the single-layer contact spring is bent to extend into a space located between the top wall and the bottom wall; and a first conductive bus bar located adjacent to the bottom wall.

14. The HV terminal frame of claim 13, further including:

a forward stop feature extending from a forward side of the second bottom wall layer and positioned to act as a stop to the first conductive bus bar.

15. The HV terminal frame of claim 13, further including:

a guide rail extending from a first side of the second bottom wall layer, the guide rail positioned to retain the first conductive bus bar on a side opposite the side wall.

16. The HV terminal frame of claim 13, further including:

first and second guide arms extending from a rear side of the second bottom wall layer, wherein the first and second guide arms retain the first conductive bar.

17. The HV terminal frame of claim 13, wherein the top wall, the side wall, the bottom wall and contact spring are formed from a single, continuous piece of material folded to the desired shape.

18. The HV terminal frame of claim 13, further including:

a second conductive bus bar received by the HV terminal frame, wherein the second conductive bus bar is forced into contact with the first conductive bus bar by the contact spring.

19. The HV terminal frame of claim 13, further including: one or more stamping features located on one or more of the top wall, the side wall, the bottom wall, a transition region between the top wall and the side wall, and a transition region between the side all and the bottom wall.

* * * * *